US012130112B1

(12) United States Patent
Hayes

(10) Patent No.: US 12,130,112 B1
(45) Date of Patent: Oct. 29, 2024

(54) ARCHERY BOW WITH LIMB SPACING ADJUSTMENT

(71) Applicant: MCP IP, LLC, Sparta, WI (US)

(72) Inventor: Mark J. Hayes, Onalaska, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 18/736,388

(22) Filed: Jun. 6, 2024

Related U.S. Application Data

(60) Provisional application No. 63/573,289, filed on Apr. 2, 2024.

(51) Int. Cl.
*F41B 5/10* (2006.01)

(52) U.S. Cl.
CPC ..... *F41B 5/105* (2013.01)

(58) Field of Classification Search
CPC .... F41B 5/10; F41B 5/105; F41B 5/14; F41B 5/1403; Y10S 124/90
USPC ..... 124/25.6, 900
See application file for complete search history.

(56) References Cited

U.S. PATENT DOCUMENTS 3,990,425 A 11/1976 Ketchum
4,337,749 A 7/1982 Barna
4,669,445 A 6/1987 Schaar
4,686,955 A 8/1987 Larson
5,307,787 A 5/1994 LaBorde et al.
5,368,006 A 11/1994 McPherson
5,623,915 A 4/1997 Kudlacek
5,649,522 A 7/1997 Troncoso
6,415,780 B1 * 7/2002 Proctor ..... F41B 5/10 124/900
6,474,324 B1 * 11/2002 Despart ..... F41B 5/105 124/25.6
6,659,096 B1 12/2003 Nealy, Sr. et al.
6,871,643 B2 * 3/2005 Cooper ..... F41B 5/10 124/900
6,964,271 B2 * 11/2005 Andrews ..... F41B 5/10 267/153
6,990,970 B1 1/2006 Darlington
7,305,979 B1 12/2007 Yehle
7,441,555 B1 10/2008 Larson
7,770,568 B1 8/2010 Yehle
8,037,876 B1 10/2011 Yehle
8,082,910 B1 12/2011 Yehle
8,181,638 B1 5/2012 Yehle
8,408,193 B2 * 4/2013 McPherson ..... F41B 5/105 124/25.6
8,469,013 B1 6/2013 Obteshka et al.
8,528,534 B2 * 9/2013 McPherson ..... F41B 5/14 124/86

(Continued)

*Primary Examiner* — Alexander R Niconovich
(74) *Attorney, Agent, or Firm* — Laabs Intellectual Property

(57) ABSTRACT

In some embodiments, an archery bow comprises a limb assembly comprising a first limb and a second limb, the second limb comprising limb threads. An axle assembly is supported by the first limb and the second limb. The axle assembly comprises an axle comprising axle threads. A first connection between the axle assembly and the first limb comprises a fixed connection. A second connection between the axle assembly and the second limb comprises the limb threads engaged with the axle threads. Rotation of the axle with respect to the limb assembly adjusts a distance between the first limb and the second limb.

18 Claims, 6 Drawing Sheets

(56) References Cited

U.S. PATENT DOCUMENTS

| | | | | |
|---|---|---|---|---|
| 8,739,769 | B1 | 6/2014 | Obteshka et al. | |
| 8,991,376 | B2 * | 3/2015 | McPherson | F41B 5/10 124/1 |
| 9,086,249 | B2 | 7/2015 | Peacemaker et al. | |
| 9,091,503 | B2 | 7/2015 | Howard | |
| 9,115,953 | B1 * | 8/2015 | Huang | F41B 5/105 |
| 9,255,759 | B1 | 2/2016 | Archer | |
| 9,347,730 | B2 | 5/2016 | Obteshka | |
| 9,528,788 | B2 * | 12/2016 | McPherson | F41B 5/14 |
| 9,568,271 | B2 | 2/2017 | Archer | |
| 9,683,806 | B1 * | 6/2017 | Yehle | F41B 5/105 |
| 10,126,087 | B1 * | 11/2018 | Grace | F41B 5/123 |
| 10,371,480 | B1 * | 8/2019 | Huang | F41B 5/10 |
| 11,486,674 | B2 * | 11/2022 | McPherson | F41B 5/1403 |
| 11,536,532 | B1 * | 12/2022 | Grace | F41B 5/1403 |
| 11,821,708 | B1 * | 11/2023 | Hansen | F41B 5/1403 |
| 2016/0033228 | A1 * | 2/2016 | McPherson | F41B 5/105 124/25.6 |
| 2017/0370673 | A1 * | 12/2017 | Yehle | F41B 5/10 |
| 2020/0158461 | A1 * | 5/2020 | Romero | F41B 5/105 |
| 2022/0074701 | A1 | 3/2022 | Sidebottom et al. | |
| 2022/0082349 | A1 * | 3/2022 | McPherson | F41B 5/105 |
| 2023/0113520 | A1 * | 4/2023 | Grace | F41B 5/105 124/25.6 |
| 2023/0358501 | A1 * | 11/2023 | Hansen | F41B 5/1403 |

* cited by examiner

ARCHERY BOW WITH LIMB SPACING ADJUSTMENT

CROSS-REFERENCE TO RELATED APPLICATIONS

This application claims the benefit of U.S. Patent Application No. 63/573,289, filed Apr. 2, 2024, the entire content of which is hereby incorporated herein by reference.

BACKGROUND OF THE INVENTION

This invention relates generally to archery bows and more specifically to adjustable systems for limb positioning and alignment in archery bows.

The limbs of an archery bow generally flex to store energy, then release the energy to propel an arrow. The positioning and alignment of the limbs can impact multiple aspects of the bow, such as accuracy and efficiency. There remains a need for novel archery bow limb systems that allow for precise and adjustable limb positioning and alignment.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a limb assembly comprising a first limb and a second limb, the second limb comprising limb threads. An axle assembly is supported by the first limb and the second limb. The axle assembly comprises an axle comprising axle threads. A first connection between the axle assembly and the first limb comprises a fixed connection. A second connection between the axle assembly and the second limb comprises the limb threads engaged with the axle threads. Rotation of the axle with respect to the limb assembly adjusts a distance between the first limb and the second limb.

In some embodiments, the first connection excludes helical threads oriented between the first limb and the axle.

In some embodiments, rotation of the axle with respect to the limb assembly moves the second limb along a length of the axle but does not move the first limb along the length of the axle.

In some embodiments, the axle assembly comprises a fastener assembly attached to the axle and the fastener assembly abuts the first limb. In some embodiments, fastener assembly comprises a fastener and a washer, the fastener engages the axle and the washer abuts the first limb.

In some embodiments, the second connection comprises a locking mechanism arranged to prevent the axle from rotating with respect to the second limb. In some embodiments, the locking mechanism comprises a fastener arranged to apply a force between the axle and the second limb.

In some embodiments, the axle comprises a flange arranged to locate a rotatable member. In some embodiments, a roller bearing contacts the flange. In some embodiments, a spacer surrounds the axle and contacts roller bearing.

In some embodiments, the first limb comprises a first bracket and the axle assembly abuts the first bracket. In some embodiments, the second limb comprises a second bracket and the second bracket comprises the limb threads.

In some embodiments, the axle comprising a marking that is visible through a window in the second bracket.

In some embodiments, an archery bow comprises a first limb comprising a first bracket and a second limb comprising a second bracket. In some embodiments, the second bracket comprises bracket threads. In some embodiments, an axle comprises a first portion and a second portion, the first portion attached to the first bracket and the second portion comprising axle threads engaged with the bracket threads. In some embodiments, rotation of the axle with respect to the second bracket adjusts a distance between the first bracket and the second bracket.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

DETAILED DESCRIPTION OF THE INVENTION

Figure 1:
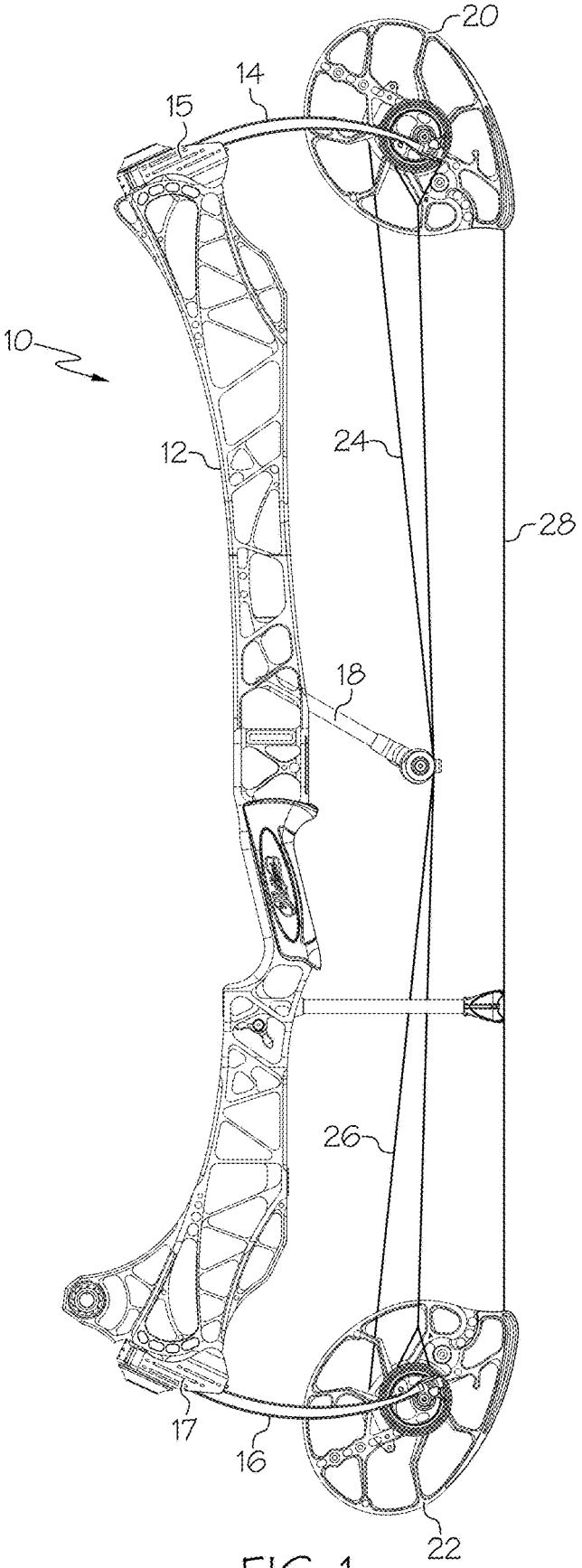
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, an archery bow 10 comprises a riser 12, which serves as the central structure. In some embodiments, a first limb assembly 14 is attached to the riser 12 by a first limb cup 15 and a second limb assembly 16 is attached to the riser 12 by a second limb cup 17.

In some embodiments, an archery bow 10 comprises a compound bow. In some embodiments, the first limb assembly 14 supports a first rotatable member 20 and the second limb assembly 16 supports a second rotatable member 22. In some embodiments, a bowstring 28 is attached to the first rotatable member 20 and to the second rotatable member 22, and arranged to unspool from the rotatable members 20, 22 as the bowstring 28 is drawn. In some embodiments, an archery bow 10 comprises a first power cable 24 arranged to be taken up by the first rotatable member 20 as the bowstring 28 is drawn. In some embodiments, the bow 10 comprises a second power cable 26 arranged to be taken up by the second rotatable member 22 as the bowstring 28 is drawn. In some embodiments, a cable guard 18 is attached to the riser 12 and arranged to position the power cables 24, 26 laterally, for example to allow clearance for an arrow.

Figure 2:
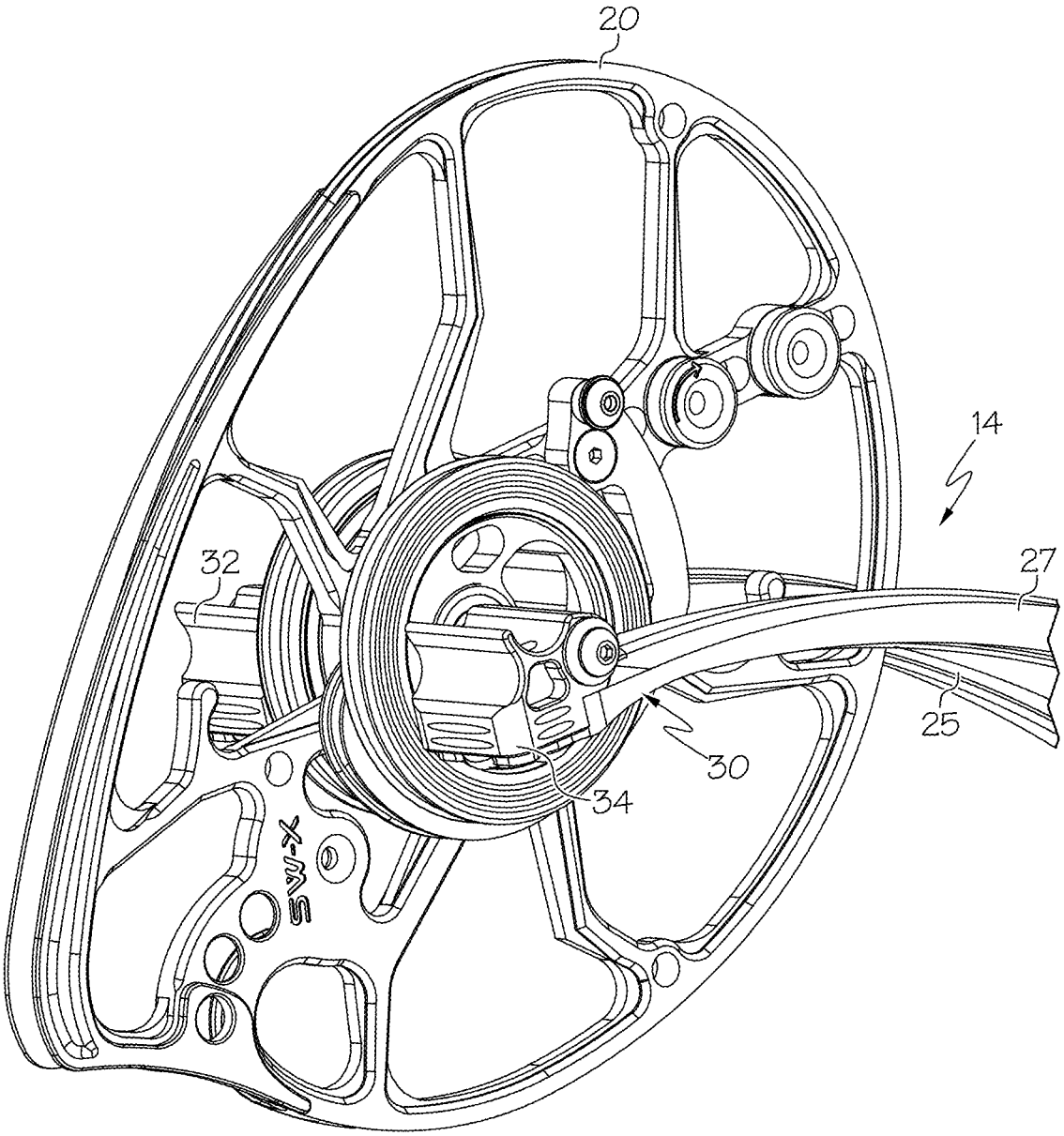
FIG. 2 shows a portion of the archery bow of FIG. 1 in greater detail.

FIG. 2 shows a more detailed view of the first rotatable member 20 and first limb assembly 14 of the archery bow 10 of FIG. 1. The bowstring 28 and power cables 24, 26 (see FIG. 1) have been omitted from FIG. 2 for clarity. In some embodiments, the first limb assembly 14 comprises a first limb member 25 positioned to a first side of the rotatable member 20 and a second limb member 27 positioned to a second side of the rotatable member 20. In some embodiments, a limb member 25, 27 can each comprise multiple limbs separated by a spacer, for example as described in US Patent Publication No. 2023/0304768, the entire disclosure of which is hereby incorporated herein by reference.

In some embodiments, the first limb assembly 14 supports an axle, and the axle supports the first rotatable member 20. In some embodiments, the axle is engaged with the first limb member 25 and with the second limb member 27. In some embodiments, the archery bow 10 comprises a limb adjustment mechanism 30 arranged to adjust a distance between the first limb member 25 and with the second limb member 27.

In some embodiments, the limb adjustment mechanism 30 is engaged with the first limb member 25 and with the second limb member 27. In some embodiments, the first limb member 25 comprises a first bracket 32. In some embodiments, the second limb member 27 comprises a second bracket 34. In some embodiments, the limb adjustment mechanism 30 comprises and/or engages the first bracket 32 and the second bracket 34. In some embodiments, the first bracket 32 is attached to the first limb member 25 and the second bracket 34 is attached to the second limb member 27. In some embodiments, the axle is engaged with the first bracket 32 and the second bracket 34, and arranged to adjust a distance between the first bracket 32 and the second bracket 34. In some embodiments, the bracket(s) 32, 34 comprise limb caps as described in U.S. Patent Application No. 63/543,014, the entire disclosure of which is hereby incorporated herein by reference.

Figure 3:
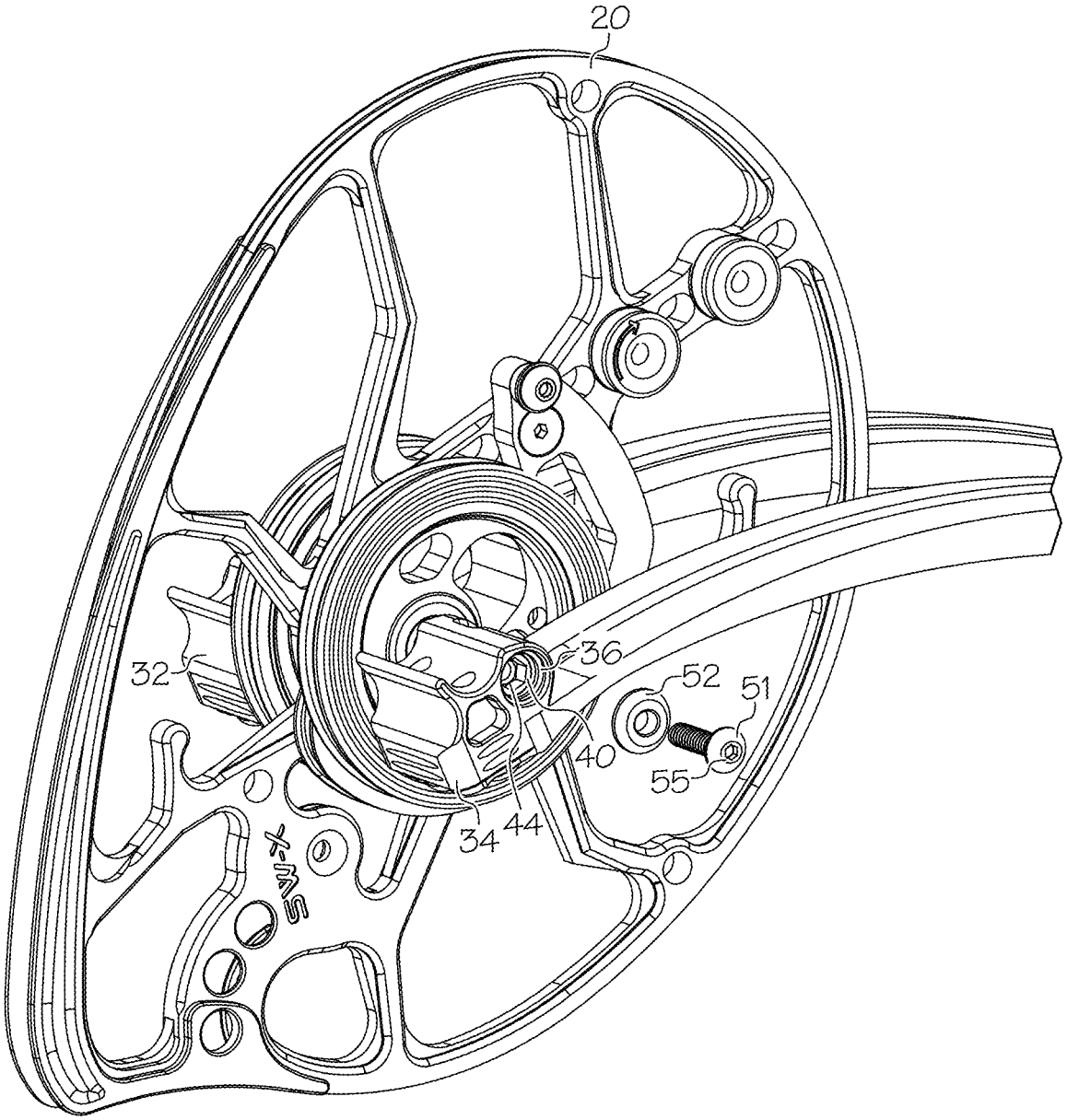
FIG. 3 shows a partially exploded view of FIG. 2.

FIG. 3 shows a partially exploded view of an embodiment of a limb adjustment mechanism 30. The bowstring 28 and power cables 24, 26 (see FIG. 1) have been omitted from FIG. 3 for clarity. In some embodiments, an axle 40 is fixedly attached to the first limb member 25 and adjustably attached to the second limb member 27, such that a location of the second limb member 27 can be adjusted with respect to the first limb member 25 and/or with respect to the axle 40. In some embodiments, the axle 40 is fixedly attached to the first bracket 32 and adjustably attached to the second bracket 34, such that a location of the second bracket 34 can be adjusted with respect to the first bracket 32 and/or with respect to the axle 40. In some embodiments, the axle 40 is threadably engaged with the second limb member 27. In some embodiments, the axle 40 is threadably engaged with the second bracket 34. In some embodiments, rotation of the axle 40 with respect to the second limb member 27 (and/or with respect to the second bracket 34) will move the second limb member 27 (and/or the second bracket 34) with respect to the axle 40, for example moving the second limb member 27 (and/or the second bracket 34) along a length of the axle 40. In some embodiments, the second limb member 27 comprises limb threads that are arranged to engage complimentary threads on the axle 40. In some embodiments, the second bracket 34 comprises bracket threads 36 that are arranged to engage complimentary threads (not visible in FIG. 3) on the axle 40. In some embodiments, rotation of the axle 40 with respect to the second limb member 27 (and/or with respect to the second bracket 34) adjusts a distance between the first limb member 25 and the second limb member 27.

In some embodiments, the axle 40 comprises a key 44, arranged to engage a tool to rotate the axle 40. A key 44 can have any suitable shape, such as a slot, Phillips, square, hex, torx, etc. In some embodiments, the limb adjustment mechanism 30 comprises a locking mechanism 55 arranged to lock the axle 40 to the second bracket 34 and prevent adjustment of the axle 40 with respect to the second bracket 34. In some embodiments, the locking mechanism 55 comprises a locking fastener 51. In some embodiments, the locking fastener 51 is threadably engaged with the axle 40 and abuts the second limb member 27 (and/or the second bracket 34). In some embodiments, a washer 52 is positioned between the locking fastener 51 and the second limb member 27 (and/or the second bracket 34). In some embodiments, a stem of the locking fastener 55 extends through the key 44 and engages a threaded cavity in the axle 40 located below key 44.

Figure 4:
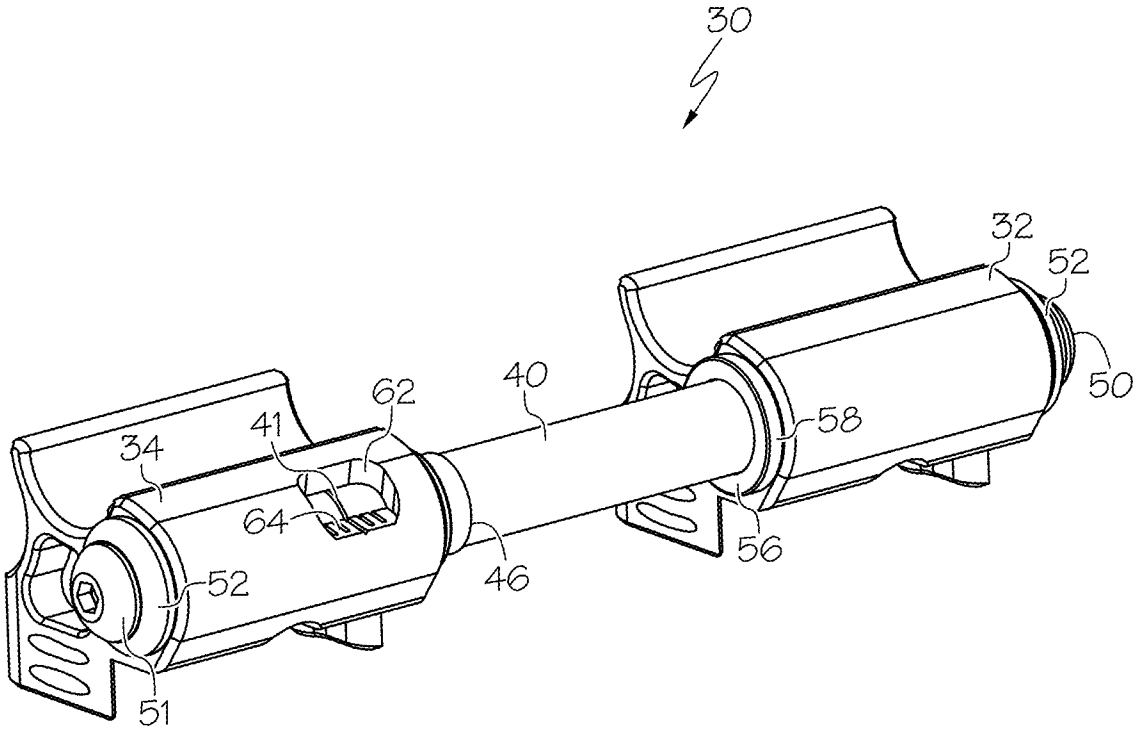
FIG. 4 shows an embodiment of a limb adjustment mechanism.
Figure 5:
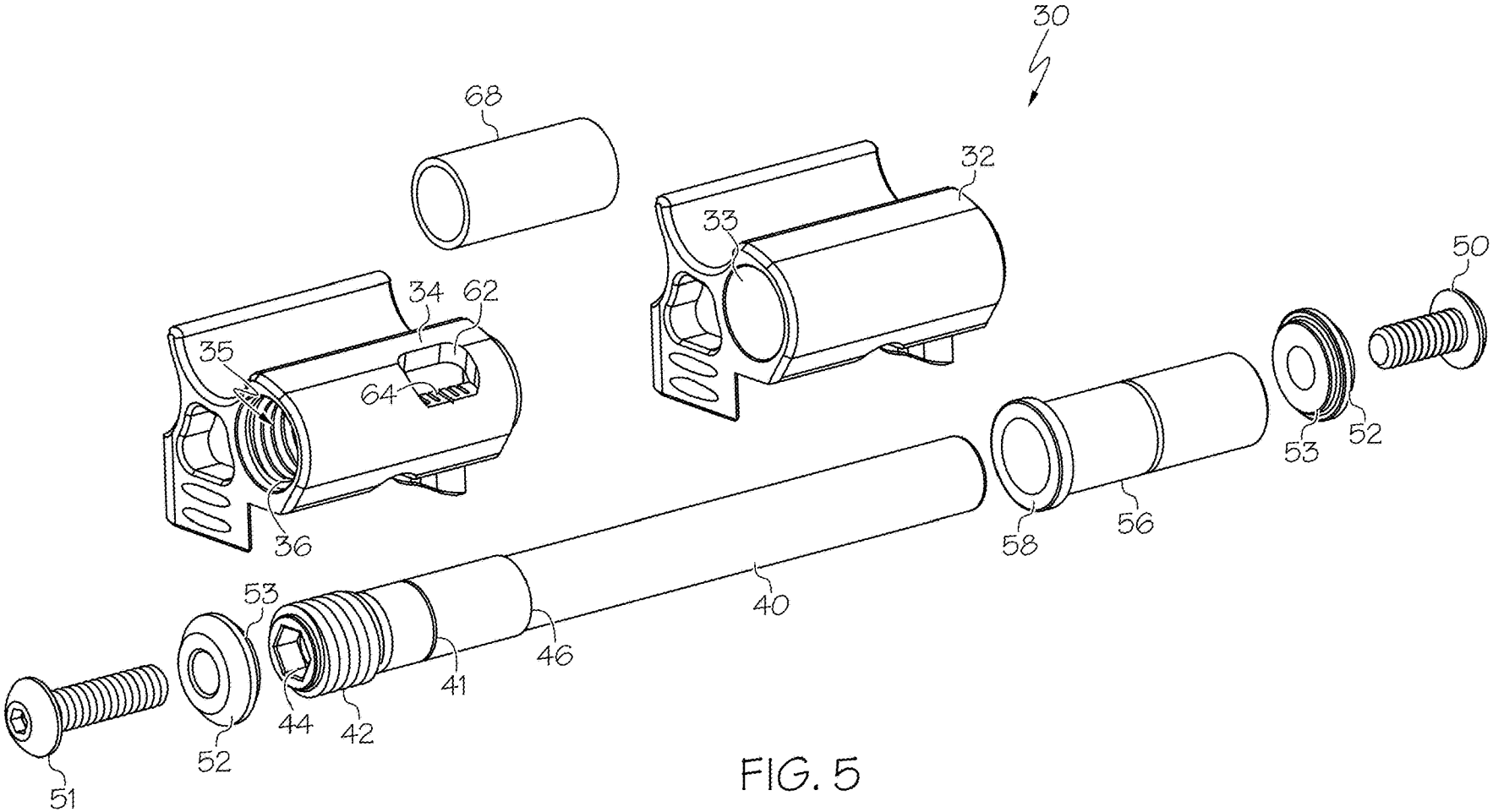
FIG. 5 shows an exploded view of the components of FIG. 4.
Figure 6:
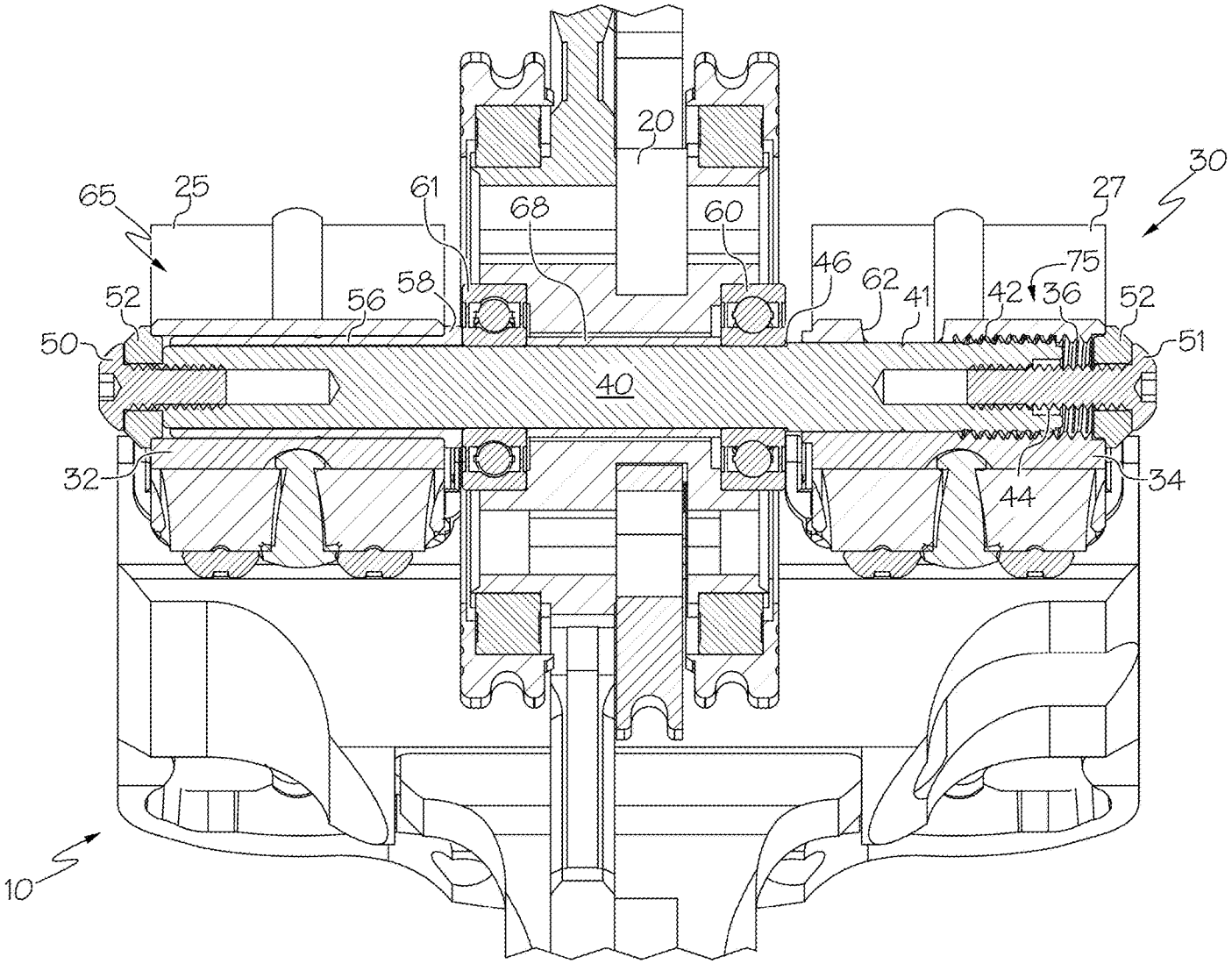
FIG. 6 shows a sectional view of an embodiment of a limb adjustment mechanism.

FIG. 4 shows an embodiment of a limb adjustment mechanism 30. FIG. 5 shows an exploded view of the components of FIG. 4. FIG. 6 shows a sectional view of an embodiment of a limb adjustment mechanism 30 in an archery bow 10.

In some embodiments, a limb adjustment mechanism 30 comprises an axle assembly engaged with the first bracket 32 and the second bracket 34. In some embodiments, the axle assembly comprises an axle 40 and at least one engagement mechanism arranged to engage a bracket 32, 34, such as a fastener 51. In some embodiments, the axle 40 is fixedly attached to the first bracket 32. In some embodiments, a fastener 50 is attached to the axle 40 and abuts the first bracket 32. In some embodiments, the fastener 50 is attached to the axle 40 and abuts a washer 52 that contacts the first bracket 32. In some embodiments, a washer 52 comprises a flange 53 that extends into the first bracket 32, for example extending into a cavity 33 defined by the first bracket 32. In some embodiments, a bearing 56 is positioned between the axle 40 and the first bracket 32. In some embodiments, the bearing 56 comprises a flange 58. In some embodiments, a rotatable member 20 supported by the axle 40 abuts the flange 58. In some embodiments, different embodiments of bearings 56 comprising flanges 58 of different size can be substituted and used to adjust a specific distance between the first bearing 32 and the rotatable member 20. This can be used to fix the rotatable member 20 a specific distance from the first bracket 32, thereby setting the specific distance between the rotatable member 20 and the first limb member 25. In some embodiments, an archery bow 10 comprises features as disclosed in U.S. Pat. No. 9,528,788, the entire disclosure of which is hereby incorporated herein by reference.

In some embodiments, an axle 40 comprises a flange 46. In some embodiments, a flange 46 comprises an increase in size of the axle 40, such as an increase in diameter. In some embodiments, the flange 46 comprises a shoulder arranged to abut and locate a rotatable member 20. In some embodiments, a roller bearing 60 that supports the rotatable member 20 contacts the flange 46 (see FIG. 6). In some embodiments, a rotatable member 20 is supported by multiple roller bearings 60. In various embodiments, the roller bearing(s)

60 can be considered part of the rotatable member 20, or alternatively, can be considered part of the limb adjustment mechanism 30.

In some embodiments, the first bracket 32 comprises a cavity 33 and a portion of the axle 40 is oriented in the cavity 33. In some embodiments, the second bracket 34 comprises a cavity 35 and a portion of the axle 40 is oriented in the cavity 35.

In some embodiments, the second bracket 34 comprises bracket threads 36. In some embodiments, the bracket threads 36 are located on an inner wall of the cavity 35. In some embodiments, the axle 40 comprises axle threads 42. In some embodiments, the axle threads 42 are located on an outer surface of the axle 40. Desirably, the bracket threads 36 and axle threads 42 are arranged to engage one another and allow for threaded engagement of the axle 40 to the second bracket 34. In some embodiments, rotation of the axle 40 with respect to the second bracket 34 will move the second bracket 34 along a length of the axle 40.

In some embodiments, a limb adjustment mechanism 30 comprises a marking 41 arranged to indicate a specific position of the axle 40 with respect to the second bracket 34. In some embodiments, the axle 40 comprises the marking 41. In some embodiments, the second bracket 34 comprises a scale 64 arranged to indicate a position of the marking 41. In some embodiments, the second bracket 34 comprises a window 62 and the marking 41 is visible through the window 62. In some embodiments, the marking 41 is arranged at a predetermined distance from a flange 46 on the axle 40, and the marking 41 can be used as an indicator of the position of the rotatable member 20 with respect to the second bracket 34. In some embodiments, the window 62 is offset from any bracket threads 36 along a length of the cavity 35.

In some embodiments, an axle assembly is supported by the first limb member 25 and the second limb member 27. In some embodiments, a limb adjustment mechanism 30 comprises a first connection 65 between the axle assembly and the first limb member 25. In some embodiments, the first connection comprises a fixed connection arranged to prevent movement of the axle assembly with respect to the first limb member 25. In some embodiments, the limb adjustment mechanism 30 comprises a second connection 75 between the axle assembly and the second limb member 27. In some embodiments, the second connection comprises an adjustable connection arranged to adjust a position of the second limb member 27 with respect to the axle assembly. In some embodiments, rotation of the axle 40 with respect to the limb assembly adjusts a distance between the first limb and the second limb. In some embodiments, rotation of the axle 40 with respect to the limb assembly moves the second limb member 27 laterally with respect to both the first limb member 25 and the rotatable member 20. In some embodiments, the second connection comprises helical screw threads engaged between the axle 40 and the second limb member 27 and/or the second bracket 34. In some embodiments, rotation of the axle 40 with respect to the limb assembly moves the second limb member 27 along a length of the axle 40 but does not move the first limb member 25 along the length of the axle 40. In some embodiments, the first connection excludes any helical threads engaged between the axle 40 and the first limb member 25 and/or the first bracket 32.

In some embodiments, a location of the first limb member 25 and a location of the rotatable member 20 along the length of the axle 40 are fixed. In some embodiments, the axle assembly is arranged to apply a compressive force to the first limb member 25 (and/or the first bracket 32) and to component(s) supporting the rotatable member 20, such as the roller bearing(s) 60. In some embodiments, a spacer 68 is provided between two roller bearings 60 arranged to support the rotatable member 20. In some embodiments, the axle assembly comprises the axle 40 and a fastener 50 engaged with the axle 40. In some embodiments, the fastener 50 creates the compressive force and the axle 40 experiences tension between the fastener 50 and the flange 46. In some embodiments, components between the flange 46 and the fastener 50 experience the compressive force. For example, as shown in FIG. 6, in some embodiments, the flange 46 of the axle 40 abuts the inner race of a first roller bearing 60; the spacer 68 abuts the inner race of the first roller bearing 60 and the inner race of a second roller bearing 61; the inner race of the second roller bearing 61 contacts the flange 58 of the bearing 56 (e.g. sleeve bearing), the flange 58 contacts the first bracket 32; and the first bracket 32 contacts the axle assembly (e.g. the fastener 50 and washer 52). The components arranged between the fastener 50 and the flange 46 (e.g. the washer 52, first limb member 25 and/or first bracket 32, the bearing flange 58, the second roller bearing 61, the spacer 68 and the first roller bearing 60) experience the compressive force. In some embodiments, these components comprise the first connection 65. In some embodiments, these components are fixedly engaged with one another, and adjustment of the limb adjustment mechanism 30 moves the second limb member 27 (and/or the second bracket 34) laterally with respect to these components.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a limb assembly comprising a first limb and a second limb, the second limb comprising limb threads;

an axle assembly supported by the first limb and the second limb, the axle assembly comprising an axle comprising axle threads;

a first connection between the axle assembly and the first limb, the first connection comprising a fixed connection that excludes helical threads oriented between the first limb and the axle; and a second connection between the axle assembly and the second limb, the second connection comprising the limb threads engaged with the axle threads;

wherein rotation of the axle with respect to the limb assembly adjusts a distance between the first limb and the second limb.

2. The archery bow of claim 1, wherein rotation of the axle with respect to the limb assembly moves the second limb along a length of the axle but does not move the first limb along the length of the axle.

3. The archery bow of claim 1, the axle assembly comprising a fastener assembly attached to the axle, the fastener assembly abutting the first limb.

4. The archery bow of claim 3, the fastener assembly comprising a fastener and a washer, the fastener engaging the axle, the washer abutting the first limb.

5. The archery bow of claim 1, the second connection comprising a locking mechanism arranged to prevent the axle from rotating with respect to the second limb.

6. The archery bow of claim 5, the locking mechanism comprising a fastener arranged to apply a force between the axle and the second limb.

7. The archery bow of claim 1, the axle comprising a flange arranged to locate a rotatable member.

8. The archery bow of claim 7, comprising a roller bearing in contact with the flange.

9. The archery bow of claim 8, comprising a spacer surrounding the axle, the spacer abutting the roller bearing, the spacer in compression along its length.

10. The archery bow of claim 1, the first limb comprising a first bracket, the axle assembly abutting the first bracket.

11. The archery bow of claim 10, the second limb comprising a second bracket, the second bracket comprising the limb threads.

12. An archery bow comprising:

a limb assembly comprising a first limb and a second limb, the first limb comprising a first bracket, the second limb comprising a second bracket, the second bracket comprising limb threads;

an axle assembly supported by the first limb and the second limb, the axle assembly abutting the first bracket, the axle assembly comprising an axle comprising axle threads;

a first connection between the axle assembly and the first limb, the first connection comprising a fixed connection; and a second connection between the axle assembly and the second limb, the second connection comprising the limb threads engaged with the axle threads;

wherein rotation of the axle with respect to the limb assembly adjusts a distance between the first limb and the second limb;

the axle comprising a marking, the marking visible through a window in the second bracket.

13. An archery bow comprising:

a first limb comprising a first bracket;

a second limb comprising a second bracket, the second bracket comprising a window and bracket threads;

an axle comprising a first portion, a second portion and a marking, the first portion attached to the first bracket, the second portion comprising axle threads engaged with the bracket threads, the marking visible through the window;

wherein rotation of the axle with respect to the second bracket adjusts a distance between the first bracket and the second bracket.

14. The archery bow of claim 13, further comprising a rotatable member supported by the axle.

15. The archery bow of claim 14, wherein the axle comprises a flange, the rotatable member abutting the flange.

16. The archery bow of claim 14, further comprising a bearing oriented between the first bracket and the axle.

17. The archery bow of claim 16, wherein the rotatable member contacts the bearing.

18. The archery bow of claim 13, further comprising a fastener attached to the axle.

* * * * *